United States Patent [19]

Bangert

[11] 4,153,978

[45] May 15, 1979

[54] METHOD FOR FIBER ALIGNMENT USING FLUID-DYNAMIC FORCES

[75] Inventor: Louis H. Bangert, Dunwoody, Ga.

[73] Assignee: Georgia Tech Research Institute, Atlanta, Ga.

[21] Appl. No.: 828,893

[22] Filed: Aug. 29, 1977

[51] Int. Cl.[2] ..... D01G 25/00

[52] U.S. Cl. ..... 19/304; 19/150

[58] Field of Search ..... 19/156.3, 150, 65 T, 19/66 T, 155, 156.4, 296, 302, 304; 264/119, 108, 91, 121; 156/62.2, 62.4; 425/80

[56] References Cited

U.S. PATENT DOCUMENTS

| | | | |
|---|---|---|---|
| 3,494,991 | 2/1970 | Mazzio et al. | 425/80 X |
| 3,619,869 | 11/1971 | Jakas et al. | 19/156.3 |
| 3,906,588 | 9/1975 | Zafiroglu | 19/156.3 |

FOREIGN PATENT DOCUMENTS

| | | | |
|---|---|---|---|
| 934194 | 8/1963 | United Kingdom | 19/150 |
| 1141698 | 1/1969 | United Kingdom | 19/156.4 |

*Primary Examiner*—Dorsey Newton

*Attorney, Agent, or Firm*—Newton, Hopkins & Ormsby

[57] ABSTRACT

A method and apparatus are provided for aligning individual fibers parallel to the main fluid stream that is conveying them, using fluid-dynamic forces. This method and apparatus are based on the use of converging streamlines in a nearly irrotational flow to provide the necessary moments to rotate the fibers so that they become parallel to the streamlines. Counterflow jets are provided to create the desired streamline behavior in a main fluid stream. The irrotationality of the flow and the nearly parallel streamlines thus prevent further fiber rotation downstream.

5 Claims, 4 Drawing Figures

METHOD FOR FIBER ALIGNMENT USING FLUID-DYNAMIC FORCES

BACKGROUND OF THE INVENTION

1. Field of the Invention

This invention relates to a method and apparatus for alignment of individual fibers in a known direction. This method and apparatus are fundamental to the development of the technology for production of fiber-woven garments with qualities like those made from yarn-woven fabrics and offer increased productivity and reduced material waste and energy consumption as compared with conventional processes of spinning staple fibers into yarn, of weaving yarn into fabric, and of tailoring garments from fabrics.

Staple fibers must be arranged in orderly patterns to produce fiber-woven fabrics with aesthetic and performance characteristics comparable to conventional woven fabrics. The fibers in the final fabric are oriented principally in two perpendicular directions so that the fibers retain bending and sliding characteristics similar to those of warp and fill yarns in conventional woven fabric.

The processes of separating, aligning (or paralleling), and depositing the fibers provide the main problems in producing fiber-woven garments. The present invention pertains to the fiber alignment part of the overall process.

2. Description of the Prior Art

Studies have been made of the movement of fibers by air flows for textile-industry related applications, some of which relate to general problems of fiber transport, with others being concerned with particular devices for producing nonwoven fabrics. As such, the same are not concerned at all with fiber alignment, but instead seek to form an isotropic fiber web. The work of Edberg, "A Basic Investigation of the Behavior of Cotton Fibers Subjected to Aerodynamic Forces", *Studies in Modern Yarn Production* 1968, pp. 96–108, is related to the problems of orienting as well as transporting fibers. In this study, air flows with fibers were observed in straight ducts which had different degrees of convergence, and it was discovered that large percentages of the fibers could be made parallel. To do so, however, required high air speeds (30 to 100 m/sec) which is undesirable for the ordered deposition of the fibers.

The patent to Jakas and Mullin ("Fiber Aligning Apparatus", U.S. Pat. No. 3,619,869, Nov. 1971) describes an apparatus in which fibers move in an accelerating air flow through a cone, and pass out of the cone through a slot and onto a moving screen. The slot width is less than the fiber length, while the slot length is greater than the fiber length. Another patent, by Marshall and Silvi ("Reorientation of Fibers in a Fluid Stream", U.S. Pat. No. 3,812,553, May 1974), also relates to fiber alignment. In this case a high-velocity fluid stream carrying fibers is formed, then decelerated to form a wide but shallow stream, and then deflected by a downward-curving wall. It is stated that this causes the fibers to be oriented in a direction substantially perpendicular to the flow direction. Specific results cited are in terms of the ratio of cross-direction to machine-direction strength of the web.

SUMMARY OF THE INVENTION

The objective of this invention is to provide a method and apparatus which aligns individual fibers parallel to the main stream flow, while maintaining low velocity to provide for orderly deposition of the fibers.

According to the present invention, individual fibers are introduced to a main airflow stream and are subsequently aligned parallel to the main flow stream through the use of fluid-dynamic forces originating from an orientating member. The aligned fibers are then deposited on a surface so that parallel alignment is maintained to form a fiber web for subsequent entanglement or bonding to produce a fiber-woven fabric.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

In general, fibers injected into a fluid stream have a random orientation. Velocity gradients of special types in the fluid stream are required to produce changes in fiber orientation, so that the fibers are turned parallel and then remain so for a sufficiently large distance.

Figure 1:
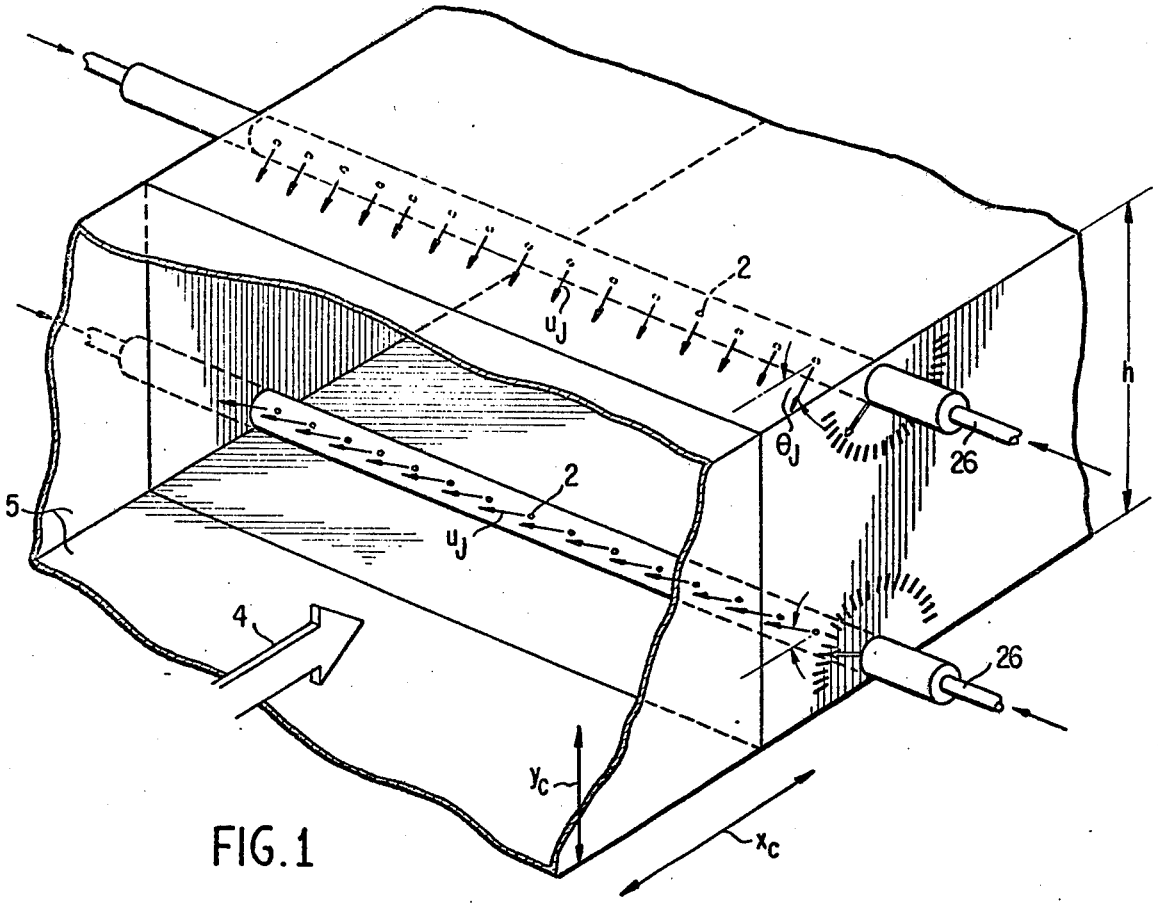
FIG. 1 is a schematic perspective view of one embodiment of the invention.

It is very important to have a system that can produce a wide variety of velocity gradients in the flow, in order to deal with different types of fibers and different main stream conditions. This system needs to be flexible, so that changes in the flow conditions can be made rapidly and easily. These considerations have led to a basic system as shown in FIG. 1 which includes a small wind tunnel 1 with counterflow jets 2. The main air stream 4 moves through wind tunnel 1 and, in the absence of counterflow jets 2, the velocity profile at any station is very nearly uniform, except for a thin boundary layer near the walls 5. The velocity profiles of main air stream 4 can be easily changed by changing the counterflow jet velocity $U_J$ and/or the counterflow jet angle $\theta_J$. The counterflow jets can be directed from 0° (downstream) to 180° (upstream). In the present configuration, each jet tube has an 11/16 inch O.D., with 37 equally-spaced orifices of 3/32 inch diameter. The object of this large number of closely-spaced orifices is to produce a flow which is two-dimensional.

Figure 2:
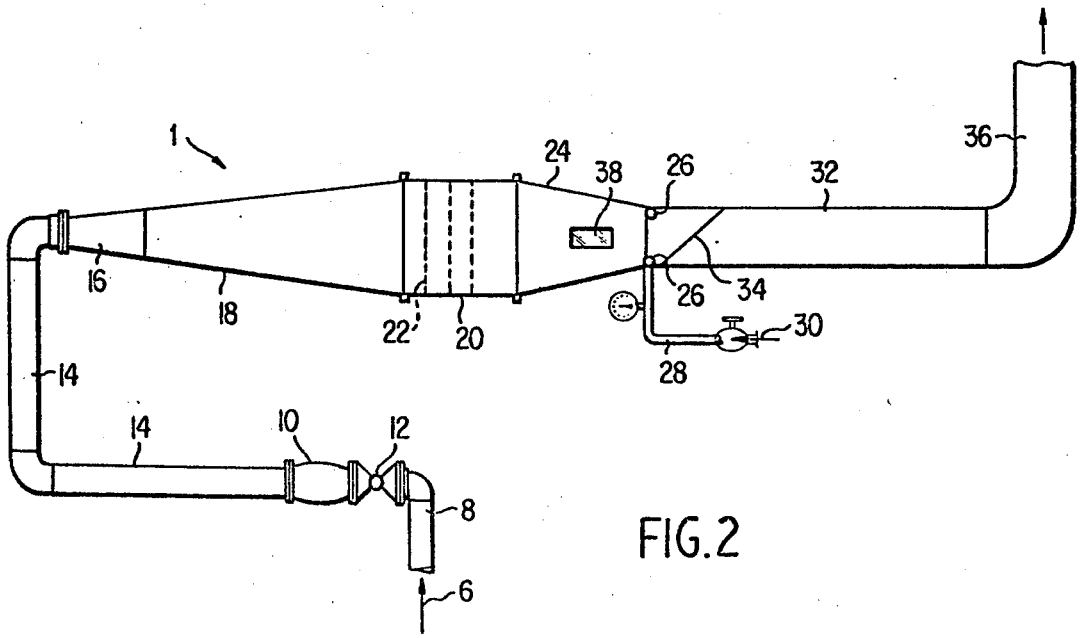
FIG. 2 is a side elevation view of a wind tunnel.

As shown in FIG. 2, wind tunnel 1 includes a primary air source 6, header pipe 8, pressure regulator 10 with reducing coupling and, supply pipe 14 which connects to the transition portion 16 of the wind tunnel. The transition portion 16 also connects to diffusor 18 which conveys the main air stream to a plenum 20 which is provided with damping screens 22. Air flow passes through contraction cone 24 prior to entering the wind tunnel cross-sectional area at which counterflow jets 2 and counterflow air injection tubes 26, which are supplied with air under pressure through secondary air source 30, operate. The main air stream then continues through the wind tunnel to a test section 32 containing a deposition screen 34 to form a fiber web with the air flow continuing on to exhaust 36.

The introduction of individual fibers into the main stream 4 flow upstream of counterflow jets 2 can be accomplished in a variety of ways. The purpose of diffusor 18, plenum 20, and contraction cone 24 is to provide a uniform, irrotational flow at the entrance to test section 32. The action of counterflow jets 2 modifies this flow, by producing a rather rapid convergence of main stream 4, followed by a rather slow divergence. The resulting velocity gradients tend to produce fiber alignment parallel to the main stream direction. Deposition surface 34 is to be placed less than one test section height h downstream of counterflow jets 2, as experiments have shown that fiber alignment occurs within this distance.

A fiber injector 38 is provided upstream of said deposition surface. The first part of the process is to obtain individual fibers from slivers containing many thousands of fibers. This can be done in a variety of ways known to current textile industry practice. For example, a slowly-rotating feed roller can be used to feed a sliver to a high-speed, toothed, opening roller which pulls individual fibers from the sliver. These individual fibers can be carried away by arranging for a suitable air flow through the apparatus. The fibers are introduced into the wind-tunnel about one-half to one test-section height h upstream of the jets. Once the individual fibers are moving in an air stream, they must be aligned, which is the subject of this invention. After alignment, the fibers are deposited on a deposition surface 34 to form a fiber web. The final step is fiber entanglement or bonding to produce a fabric (not shown).

Either natural or synthetic fibers may be carried by the main air stream 4 and aligned parallel to the air flow direction, as described above. The fibers are then deposited on deposition surface 34 placed in the air flow, such as a screen, and during deposition the fibers retain their alignment. By a similar fiber alignment process, fibers may be aligned in a direction perpendicular to the first and be deposited on deposition surface 34. The result is a loose web of fibers on deposition surface 34 aligned in two perpendicular directions. The two perpendicular directions of fiber alignment can be achieved with a single air flow system by suitably reorienting deposition surface 34 during the deposition process. Alternatively, two separate air flow systems depositing fibers on a surface of fixed orientation could be used. After the fiber web has been formed, the fibers are entangled or bonded using an existing process. The result is a fabric which has the desirable characteristics associated with fiber alignment in two perpendicular directions as previously noted.

Figure 3:
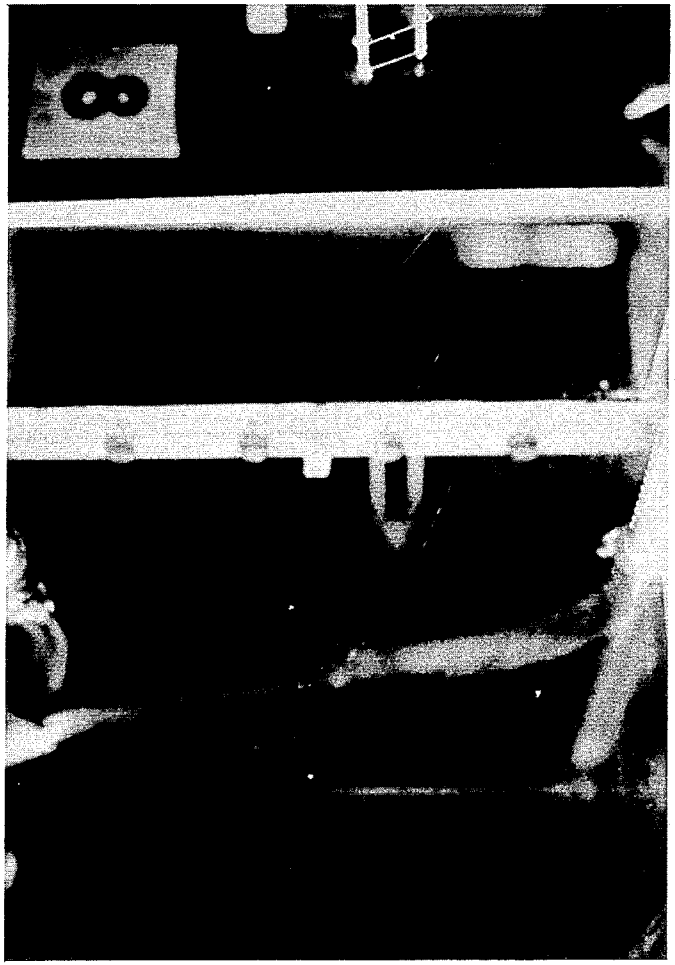
FIG. 3 is a photograph of the test section of the wind tunnel showing a fiber at several points along its path.

The principal data on the fiber motion are multiflash photographs of the fiber trajectory as typified by FIG. 3. This photograph shows the fiber at several points along its path and was made using a stroboscopic light source (not shown), with the room darkened.

The basic concept of fiber orientation using the counterflow jets is as follows. Upstream of counterflow jets 2, the fiber is in a uniform flow, and its orientation does not change because this flow is essentially irrotational. The jets produce an effective nozzle wall for main stream 4, so that the streamlines converge toward the center of the test section and the flow accelerates. Downstream of the jets, the central irrotational core decelerates, and its streamlines remain nearly parallel to the test section centerline.

A fiber that is parallel to the mainflow streamlines upstream of counterflow jets 2 remains so throughout, and continues parallel to the duct centerline downstream of the jets. A fiber that is initially at an angle relative to the mainflow streamlines is rotated to a parallel orientation by the streamline convergence near jets 2. The streamlines nearer to walls 5 are accelerated toward the centerline, so that a resultant moment is applied to a fiber that lies across the streamlines. This moment goes to zero when the fiber becomes parallel to the streamlines, so the fibers retain their parallel orientation downstream of the jets in this still nearly irrotational flow.

The nondimensional parameters that govern the fiber motion are as follows:

(1) $x_c/h$ and $y_c/h$, the position ($x_c$) of fiber release upstream of the jets and above ($y_c$) the lower wall of the test section, respectively, are shown in FIG. 1. Again, h is the height of the test section.

(2) $\dot{m}_\infty/\dot{m}_j$, the ratio of main stream flow rate to jet flow rate.

(3) $\theta_j$, the counterflow jet angle.

(4) $\phi_o$, the initial fiber angle relative to the main stream. (For appropriate combinations of the other parameters, the fibers become parallel to the test section centerline, independent of $\phi_o$).

(5) $l_f/d_f$, the ratio of fiber length to diameter.

(6) $\rho_f/\rho_\infty$, the ratio of fiber density to main stream air density.

(7) $l_f/h$, the ratio of fiber length to test-section height.

(8) $\rho_\infty U_\infty^2/\rho_f d_f g$, the ratio of aerodynamic lift force on the fiber to the gravitational force. This parameter is a measure of how rapidly the fiber drops toward the lower wall of the test section. $U_\infty$ is the velocity of the main stream flow which, for most experiments was 20 ft/sec.

(9) $\rho_\infty U_\infty d_f/\mu_\infty$, the Reynolds number.

These parameters have been varied in experiments performed to demonstrate the concepts described previously. From the results that have been obtained, it may be concluded that the basic principles of operation of the system to produce parallel fiber orientation have been demonstrated.

EXAMPLE 1

As shown in FIG. 3, the values of the above-noted parameters were as follows:

(1) $x_c/h=-0.5$ ($x_c=0$ at the counterflow jets. Thus, the fibers were released one-half test section height upstream of the jets).

$$y_c/h=0.6$$

$$\dot{m}_\infty/\dot{m}_j=37 \quad (2)$$

$$\theta_j=90° \quad (3)$$

$$\phi_o=120° \quad (4)$$

$$l_f/d_f=420 \quad (5)$$

$$\rho_f/\rho_\infty=1290 \quad (6)$$

$$l_f/h=0.0833 \quad (7)$$

$$\rho_\infty U_\infty^2/\rho_f d_f g=48 \quad (8)$$

$$\rho_\infty U_\infty d_f/\mu_\infty=24 \quad (9)$$

The above values of these parameters are typical for the experiments performed, but successful operation is not restricted to these values.

The fiber alignment occurs in a very short distance (less than one foot), while maintaining a low air stream velocity (25 ft/sec or less). The use of counterflow jets 2 to achieve the desired velocity gradients provides great flexibility for the system, because changes in flow conditions can be made rapidly and easily. This is important when dealing with changes in fiber geometry and properties, and also allows greater flexibility in the choice of main stream flow conditions.

Figure 4:
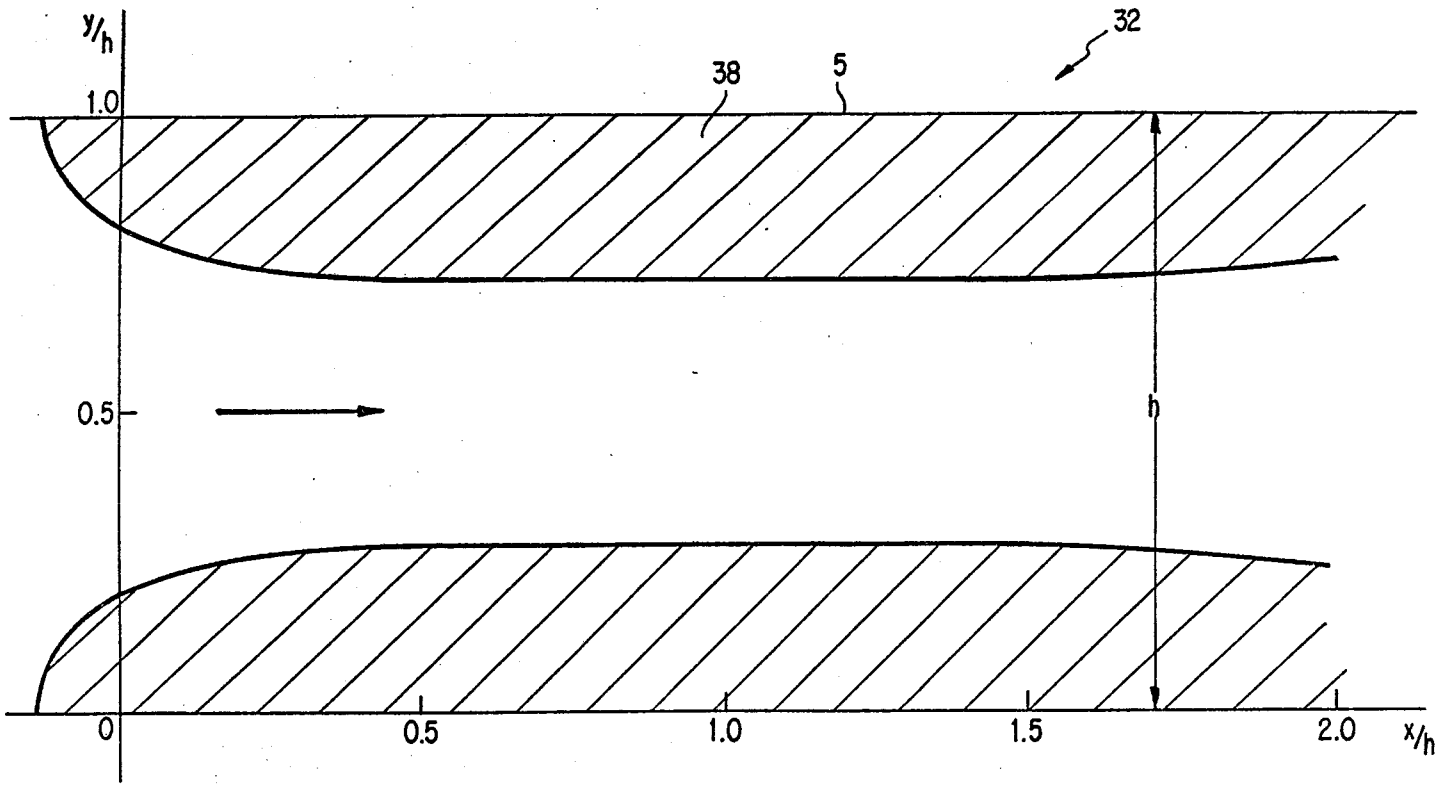
FIG. 4 is a sectional view of another embodiment of the invention.

It is also possible to provide the required velocity gradients by a second embodiment using suitably designed impermeable or semi-permeable solid boundaries 38 as shown in FIG. 4. A particular geometry of this type might then serve to replace the counterflow jets for a particular jet flow rate and jet angle. Such arrangement makes use of the same basic principle of fiber alignment described previously.

FIG. 4 shows a theoretical body shape which roughly approximates the effect of the jets on the mainstream flow. Here, $x/h=0$ corresponds approximately to the location of the jets. In the first embodiment, the jets produced a rather rapid contraction of the mainstream, followed by a rather slow divergence. In the second embodiment, an equivalent solid body produces a similar behavior in the mainstream.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for aligning randomly-oriented individual fibers, which comprises:

an air flow housing;

means operatively connected to one end of said housing for generating an air flow stream axially through said housing;

means for introducing said fibers to said housing, connected to said housing;

orientation means, producing velocity gradients in said airflow stream, located adjacent said fiber introducing means, whereby said fibers are aligned in a direction parallel to said airflow stream and wherein said orientation means comprises air supply tubes including jets provided thereon, which produce a counterflow of air with respect to said airflow stream.

2. The apparatus of claim 1, wherein means is provided for adjusting the angle of flow and means is also provided for adjusting the flow rate of said counterflow jets with respect to said airflow stream.

3. The apparatus of claim 2, wherein said adjustable angle is between 0° and 180°.

4. A method of aligning randomly-oriented individual fibers, comprising:

directing a stream of air through a housing at a predetermined velocity;

introducing said fibers into said stream of air;

reorienting said fibers by the use of counterflow air jets such that said fibers are aligned in a parallel direction; and, depositing said aligned fibers on a surface placed in said stream of air such that a fiber web is thereby formed with an alignment parallel to said stream of air.

5. The method of claim 4, further comprising the steps of:

directing a second stream of air through a second housing connected to said first housing;

introducing said fibers into said second stream of air simultaneously with said fiber introducing step in said first stream of air;

reorienting said fibers in said second stream of air such that said fibers in said second stream are aligned in a parallel direction; and depositing said aligned fibers in said second stream of air on said surface such that two perpendicular alignments of said fibers are formed on said surface.

* * * * *

UNITED STATES PATENT AND TRADEMARK OFFICE

CERTIFICATE OF CORRECTION

PATENT NO. : 4,153,978

DATED : May 15, 1979

INVENTOR(S) : Louis H. Bangert

It is certified that error appears in the above–identified patent and that said Letters Patent are hereby corrected as shown below:

Column 1, after line 3, insert:
--- The Government has rights in this invention pursuant to grant APR-74-02326 awarded by the National Science Foundation. ---

Signed and Sealed this

*Sixth* Day of *May 1980*

[SEAL]

*Attest:*

SIDNEY A. DIAMOND

*Attesting Officer*

*Commissioner of Patents and Trademarks*